United States Patent [19]

Horigome et al.

[11] 3,995,193

[45] Nov. 30, 1976

[54] MICROWAVE TUBE HAVING STRUCTURE FOR PREVENTING THE LEAKAGE OF MICROWAVE RADIATION

[75] Inventors: Toshinori Horigome; Sadanori Hamada; Takami Sato, all of Tokyo, Japan

[73] Assignee: Nippon Electric Company, Ltd., Tokyo, Japan

[22] Filed: Apr. 11, 1975

[21] Appl. No.: 567,257

[30] Foreign Application Priority Data

Apr. 20, 1974 Japan ..... 49-44897

[52] U.S. Cl. ..... 315/5.38; 315/3.5; 333/77

[51] Int. Cl.[2] ..... H01J 23/02

[58] Field of Search ..... 315/3.5, 5.38, 5.39; 333/79

[56] References Cited

UNITED STATES PATENTS

| | | | |
|---|---|---|---|
| 2,409,664 | 10/1946 | Clifford | 315/5.38 X |
| 3,284,660 | 11/1966 | Abraham et al. | 315/5.38 X |
| 3,471,739 | 10/1969 | Espinosa | 315/538 X |
| 3,483,419 | 12/1969 | Luebke | 315/5.39 X |
| 3,526,798 | 1/1970 | Sandstrom | 315/5.38 X |
| 3,748,513 | 7/1973 | Levin | 315/5.38 |
| 3,852,636 | 12/1974 | Edgcombe | 315/5.38 |
| 3,859,558 | 1/1975 | Harada et al. | 333/79 |

*Primary Examiner*—Saxfield Chatmon, Jr.

[57] ABSTRACT

Shielding means for preventing the emission of microwave radiation from microwave tubes which are typically comprised of an electron gun source, an intermediate body section and a collector section electrically isolated from the adjacent body section by means of a ceramic seal. A metallic shield has one end connected to the body section (or the collector section) and has its other end spaced from the collector section (or body section). An insulation layer is interposed in the gap space between the shield and the collector section (or body section). A microwave energy-lossy body is arranged in contact with one or both sides of the insulation layer to absorb microwave radiation transmitted along the insulation layer so as to prevent emission of potentially harmful microwave energy from the tube. The insulation layer may comprise either a linear or elongated tortuous undulating path. The shielding means may further be enclosed in an outer waterproof insulation layer to maintain the integrity of the desirable electric insulation properties between the body section and the collector section.

13 Claims, 6 Drawing Figures

MICROWAVE TUBE HAVING STRUCTURE FOR PREVENTING THE LEAKAGE OF MICROWAVE RADIATION

BACKGROUND OF THE INVENTION

The present invention generally relates to a microwave tube for use in amplification of microwave signals such as a klystron or travelling wave tube, and more particularly, to shielding means for a microwave tube having a structure in which a body section and a collector section are electrically isolated from each other.

Microwave tubes typically are comprised of a body section including a slow wave circuit or a cavity for achieving an amplification through an interaction between an electron beam and an input signal wave and a collector section for eventually capturing the electron beams. Recently, one type of microwave tube which is presently being manufactured in large quantities and is in widespread use, is designed to have a configuration such that the body section and the collector section are insulated from each other by a ceramic seal, enabling body current and collector current to be individually measured and also for the purpose of providing high operating efficiency by the application of a reduced voltage to the collector section with respect to the body section. However, the present day techniques employed for insulating the body section from the collector section as described above, have been found to create a disadvantageous condition wherein microwave energy has been found to leak out of the tube through the insulating portion and be fed back to an input portion of the tube, resulting in degradation of the tube performance and, in the worst case, resulting in undesirable oscillation.

Furthermore, in the case of a high power tube, a health risk is involved in that the body of an operator is subjected to the adverse effects of the leaked microwave energy at the time of the adjustment of the tube. The leakage of microwave radiation must, therefore, be reduced to a safe level.

Heretofore, as a solution for the aforementioned problem, it has been proposed to provide a structure in which the length of the gap space in the insulating portion is selected to be equal to ¼ wavelength or ½ wavelength measured at the operating frequency of the tube, in order to form a choke, but this structure involves a problem in manufacture with respect to the dimensions required to achieve the aforesaid objects.

Another proposal contemplates the shielding of a leaked microwave signal by covering said insulating portion with a metallic shield body having its one end connected to the body section and having the gap space for insulation arranged between the other end thereof and the collector section so that said gap space is made as narrow as possible. However, when it is intended to apply this shielding means to the above-referred depressed collector potential type of microwave tubes in which a voltage of thousands to tens of thousand volts is applied across the insulating portion, the gap space for insulation cannot be made too narrow is view of the necessity for providing a minimum level of withstanding voltage, and accordingly, the leakage of microwave energy through the gap space cannot be neglected, making the provision of perfect shielding impossible in present day devices.

BRIEF DESCRIPTION OF THE INVENTION AND OBJECTS

Accordingly, it is one object of the present invention to provide a microwave tube of the type having a body section and a collector section insulated from each other by a ceramic seal with a view to preventing leakage of microwave radiation through the insulating portion by a technique which includes the covering of said insulating portion with a metallic shield body, in which microwave radiation leaking out of the gap space for insulation between the shield body and the collector section can be effectively suppressed.

According to the present invention, interposed in the gap space between a metallic shield body having its one end connected to the body section (or the collector section) and the collector section (or the body section) opposed thereto is an insulator layer having a high voltage withstanding property, the gap space distance being selected as narrow as possible within an admissible range of breakdown voltage, and a microwave-lossy body is provided on at least one surface of the insulator layer to cause the microwave radiation that would normally tend to leak out through said insulator layer to be dispersed and absorbed by said microwave energy-lossy body, whereby the energy of the microwave signal passing through said insulator layer may be relatively weakened and eventually the leaked microwave radiation may be significantly reduced to levels which enable human operators to work in the vicinity of such tubes without any risk to their health and well being.

According to another aspect of the present invention, said insulator layer is designed to extend beyond the confines of the shield body, and a microwave-lossy body is provided along at least one surface of the insulator layer in the region of this extended portion to cause the microwave radiation, which might otherwise leak out through said insulator layer, to be dispersed and absorbed by said microwave energy-lossy body outside of the metallic shield body, whereby undesirable leakage can be prevented.

BRIEF DESCRIPTION OF THE DRAWINGS

The above, as well as other objects of the invention, will become apparent upon a consideration of the accompanying detailed description and drawings, in which.

DETAILED DESCRIPTION OF THE INVENTION

Figure 1:
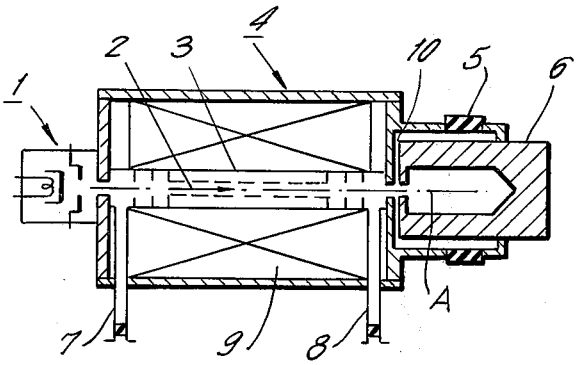
FIG. 1 is a cross-sectional view schematically showing the basic elements of a waveguide type travelling wave tube included in the microwave tubes to which the present invention is directed.

Now the present invention will be described in more detail with reference to the accompanying drawings. FIG. 1 is a schematic view generally showing the structure of a cavity slow-wave circuit type travelling wave tube included in microwave tubes of the type to which the present invention is directed. In this figure, reference numeral 1 designates an electron gun for emitting an electron beam 2. The emitted electron beam 2 interacts with an input microwave signal introduced from an input signal entrance portion 7 provided in a body section 4 and including a cavity-type slow-wave circuit 3. The modulated electron beam is eventually collected by a collector section 6 that is insulated from the body section 4 via a ceramic seal 5. On the other hand, the input microwave signal is amplified through the interaction with the electron beam 2, and is led out as an amplified microwave signal from an output portion 8. Reference numeral 9 designates a coil of an electromagnet for focusing the electron beam 2, which coil is wound around the slow-wave circuit 3.

In the conventional microwave tube as described above, a part of the amplified microwave signal enters into a gap space 10, located in the region where the body section 4 and the collector section 6 are arranged in opposed spaced fashion and in close proximity to each other, and then propagates around the exterior of the collector section 6 so as to leak out through the insulating portion 5 consisting of a ceramic seal, resulting in various adverse effects.

Figure 2:
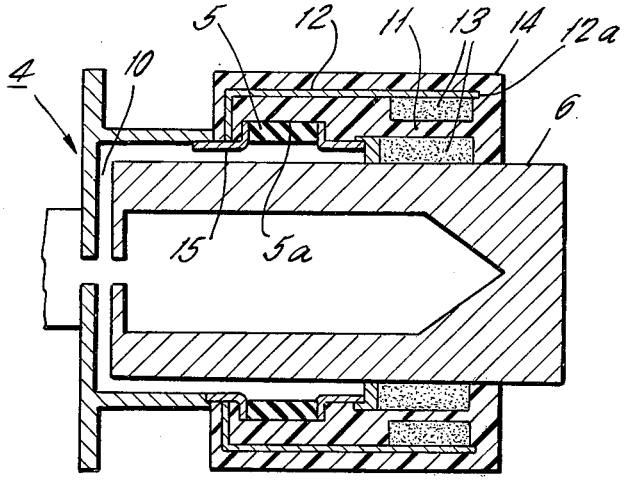
FIG. 2 is an enlarged cross-sectional view of an essential part of one preferred embodiment of the present invention.

FIG. 2 is an enlarged cross-sectional view showing a collector section 6 and one end portion of a body section 4 of a waveguide-type travelling wave tube which embodies the present invention. In this figure, a microwave shield body 12 formed of a copper plate, having one end in firm electrical contact with the body section 4 via plate 15 and having an insulator layer 11 interposed between the other end thereof and the collector section 6 in order to insulate body 12 from collector 6. The insulator layer 11 is formed by filling the gap region with silicone rubber to cover the exterior surface of 5*a* of the insulating portion 5 consisting of a ceramic seal. In addition, the upper and lower surfaces of the insulator layer 11 in the open gap space formed between end 12*a* of the shield body 12 and the collector section 6, are in intimate contact with microwave energy-lossy bodies 13 that are formed by solidifying graphite. The length of the lossy bodies is of the order of tens of millimeters measured in the direction parallel to the tube axis A (see FIG. 1).

According to the embodiment of FIG. 2, most of the microwave energy that leaks through the insulating portion 5 to the shielded space surrounded by the shield body 12 is concentrated into the insulator layer 11 which has a high dielectric constant, and this energy tends to leak out through the insulator layer 11. However, because of the fact that the microwave energy-lossy bodies 13 are provided along both the upper and lower surfaces of the insulator layer 11, almost all of the leaked microwave energy is dispersed towards both the upper and lower surfaces of insulator 11 and is absorbed by the microwave energy-lossy bodies 13 as the microwaves propagate from the left-hand end of the insulator layer 11 towards the right-hand end (relative to FIG. 2). Therefore, the microwave energy leaking out of the right-hand end of insulator 11 to the exterior region surrounding collector 6 would become negligibly small. In addition, in the embodiment shown in FIG. 2, by covering the entire shield body with an external insulator 14, the breakdown discharge path extending along the outer surface can be elongated and thus the withstand voltage can be further enhanced. Furthermore, since the insulator 14 is preferably of a water-tight nature and covers also the body section and the collector section, it is also useful for preventing leakage of coolant (i.e., water) for cooling the collector, as well as preventing any degradation of insulation level that would otherwise be caused by the collection of moisture in a highly humid atmosphere.

Figure 3:
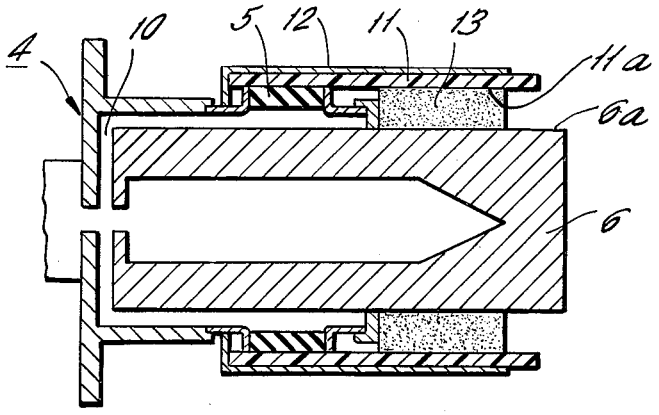
FIG. 3 is an enlarged partial cross-sectional view of another preferred embodiment of the present invention in which a lossy body is provided along one surface of an insulator layer.

FIG. 3 shows an essential part of another preferred embodiment of the present invention, in which one side surface of an insulator layer 11 consisting of Teflon is brought in intimate contact with a shield body 12, and between the interior surface 11*a* of layer 11 and the exterior 6*a* of collector section 6 is interposed a microwave energy-lossy body 13 for attenuating microwave energy leaking out of the gap provided for insulation of the shielding space formed by the shield body 12.

In this structure, since the leaked microwave radiation is absorbed through one side surface of the insulator layer 11, the absorption efficiency is somewhat deteriorated in comparison to the embodiment of FIG. 2 where the leaked microwave energy is absorbed through both side surfaces. However, the arrangement of FIG. 3 has the advantage of providing a less complicated structural arrangement which is easy to manufacture since the microwave energy-lossy body 13 need not be divided into two layers. Also, the outer diameter of the shield body 12 can be made smaller than that of the embodiment in FIG. 2.

Figure 4:
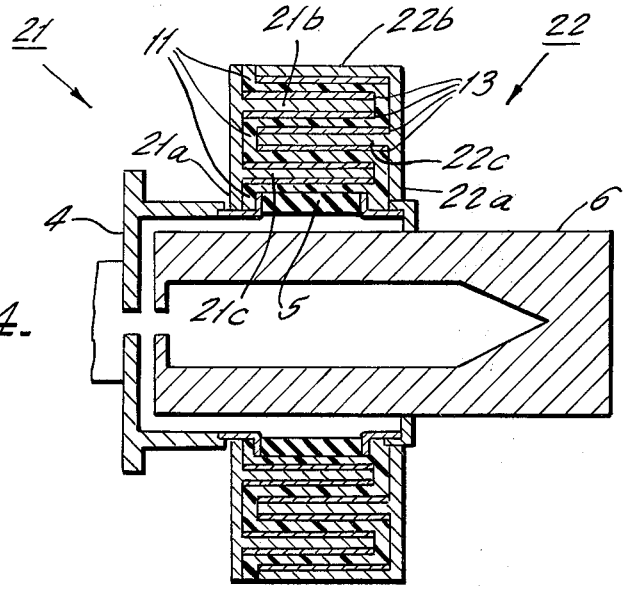
FIG. 4 is an enlarged cross-sectional view of an essential part of still another embodiment of the present invention in which a tortuous gap space is provided.

FIG. 4 shows an essential part of a still another preferred embodiment of the present invention, in which a ceramic seal insulating portion 5 is covered by a shield plate 21 of substantially F-shaped cross-section consisting of a vertical portion 21*a* extending radially outward from the body section 4 and two cylindrical portions 21*b* and 21*c* integral with and extending from said vertical portion and arranged parallel to the tube axis. A second shield plate 22 having a similar configuration is disposed on the collector section 6 and comprises a radially aligned portion 22*a* and integral cylindrical portions 22*b* and 22*c* opposed to those like portions of the shield plate 21 and arranged in a mutually interlaced and telescoping relationship. A microwave-lossy body 13 is adhered onto the cylindrical wall surfaces of a tortuous undulating gap space path formed by the interlaced cylindrical portions, and an insulator layer 11 is formed by insertion of silicone rubber into the hollow gap space for insulating the body section and the collector section from each other. In the structure of FIG. 4, the microwave energy tends to leak out through the insulator layer 11, which defines an elongated, undulating tortuous path having both of its opposed surfaces in firm contact with microwave-lossy bodies, so that the leaking microwave energy can be completely absorbed by the microwave-lossy bodies 13 during its propagation through the long tortuous path, and thus the leakage to the exterior of the structure can be substantially reduced to zero. In other words, although the above-described embodiment is somewhat complex in structure, it is very effective in cases where it is desired it provide complete leakage prevention for microwave energy.

Figure 5:
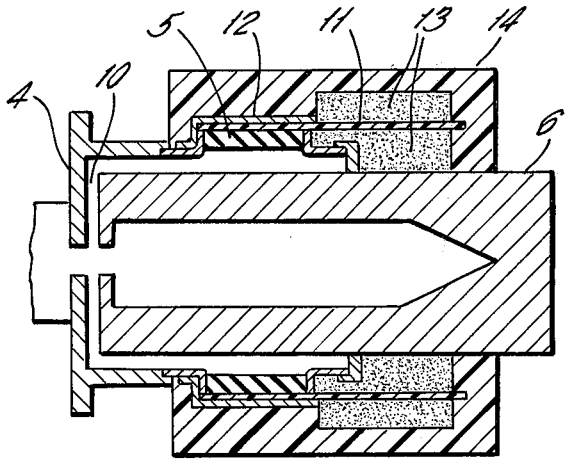
FIG. 5 is a cross-sectional view of an essential part of yet another preferred embodiment of the present invention.

FIG. 5 shows an essential part of a yet another preferred embodiment of the present invention wherein the shielding space formed by a shield body 12 covering the outside of a ceramic seal insulating portion 5, instead of being provided with a microwave energy-lossy body 13, is provided with an insulator layer 11 for insulating the shield body 12 from a collector section 6, which layer 11 extends to the exterior of the shielding space, and both the upper and lower surfaces thereof are covered (if one surface is tightly contacted to an electric conductor, another surface is covered) by a microwave energy-lossy body 13, except for a small portion at its tip end for elongating the insulating distance along the surface. In this case, the leaking microwave energy will eventually reach the outlet of the shielding space through the narrow path formed by the insulator layer 11. However, due to the presence of the lossy bodies 13 on opposite surfaces of the further extended insulator layer 11, the microwave energy, which tends to radiate outwardly through the opposite surfaces of the insulator layer 11 is absorbed by the microwave-lossy bodies 13 and cannot be radiated outwardly, and therefore, almost all the leaking microwave energy is attenuated during its propagation through the extension of the insulator layer 11 up to its right-hand end.

The advantage of this embodiment resides in the fact that the lossy body is not provided within the shielding space, enabling the outer dimension (i.e., outer diameter), of the shield body 12 to be made quite small, and the mounting of the lossy bodies 13 is also simplified.

It is to be noted that an external insulator layer 14 prevents any lowering of the withstand voltage caused by a highly humid atmosphere and/or leakage of coolant water similar to the embodiment shown in FIG. 2. The layer 14 is preferably formed of silicone rubber.

Figure 2A:
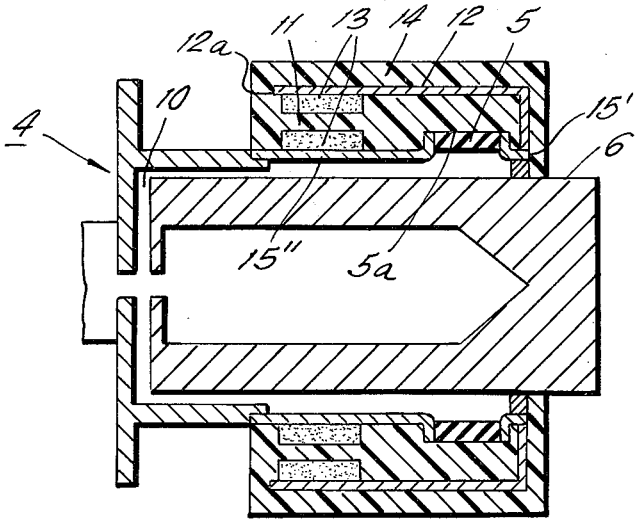
FIG. 2A shows a modification of the preferred embodiment of FIG. 2.

In the above-described embodiments, a structure of a shield body having one end connected to a body section and having an insulating gap space opening directed towards a collector section has been explained. However, it is a matter of mere choice within the capability of those with ordinary skill in the art that in some cases the shield body structure can be modified so that one end thereof electrically engages the collector section and the insulating gap space opening is directed towards the body section. For example, considering FIG. 2A, the conductive element 15'' is shown as being electrically connected to body section 4 and element 15' is electrically connected to the collector section 6. The metallic shield body 12 is electrically connected to conductive section 15' while its left-hand end is electrically insulated from the body section 4. All other elements as between FIGS. 2 and 2A occupy substantially the identical positions relative to one another. In the same manner that FIG. 2A shows the shield body 12 to be electrically connected to the collector section, FIGS. 3 and 5 can likewise be modified in a similar fashion.

As described above, heretofore, in a microwave tube of the type that a body section and a collector section are insulatively separated from each other, even if it is intended to shield a leaking microwave by covering a ceramic seal portion for insulation with a metallic shield body, there existed an undesirable condition wherein microwave energy was able to leak out through an insulator layer for insulating said shield body from an opposed collector section or body section to make perfect shielding of the microwave energy impossible through the use of existing techniques. However, according to the present invention, the addition of simple means consisting of a microwave-lossy body (or bodies), distributed and interposed along one or both surfaces of an insulator layer, reduces the leaked microwave energy almost to zero, achieving a very excellent effect of eliminating various disadvantages caused by the leakage of such microwave energy.

We claim:

1. A microwave tube having a vacuum enclosure in which a conductive body section and a conductive collector section are incorporated as part of the vacuum enclosure and are electrically isolated from each other by a small ceramic insulating seal also forming an integral part of the vacuum enclosure and being covered by a metallic shield body having one end connected to said body section and overlying and spaced from said ceramic seal and said collector section, an insulator layer being interposed into the space between said metallic shield body and said ceramic seal and said collector section for electrically insulating the body and collector sections from one another, characterized in that a microwave-lossy body is provided along at least one surface of said insulator layer to absorb microwave energy which may be transmitted along the insulator layer.

2. The structure of claim 1 wherein said lossy body is displaced from said ceramic seal.

3. The tube structure of claim 1 wherein said ceramic seal is annular in shape and surrounds said collector section;

said shield body being a cylindrical shaped shell;

the axial length of said ceramic seal being shorter than the axial length of said shield and said collector section.

4. The tube structure of claim 3 wherein said insulator layer is annular shaped, the axial length of said layer being at least as great as the axial length of said shield.

5. The tube structure of claim 4 wherein one surface of said insulation layer engages said shield and a portion of the opposite surface of said insulation layer engages said microwave-lossy body.

6. The tube structure of claim 5 wherein a spaced portion of one cylindrical surface of said insulation layer respectively engages said shield and said microwave-lossy body; a second microwave-lossy body engaging the other cylindrical surface of said insulation layer.

7. The tube structure of claim 4 wherein said lossy body is a substantially cylindrical shaped body.

8. The tube structure of claim 1 wherein said vacuum envelope is covered with a waterproof insulation layer positioned over said shield and portions of said body and collector sections.

9. A microwave tube enclosure in which a conductive body section and conductive collector section are incorporated as part of the vacuum enclosure and are electrically isolated by a small ceramic insulating seal also forming an integral part of the vacuum envelope, said insulating seal being covered by a metallic shield body having one end connected to said collector section and overlying and spaced from said ceramic seal and said body section, an insulator layer being interposed into the space between said metallic shield body and said ceramic seal and said body section for insulating the body and collector sections from one another, characterized in that a microwave loss-lossy body is provided along at least one surface of said insulator layer to absorb microwave energy which may be transmitted along the insulator layer.

10. A microwave tube having a vacuum enclosure in which a body section and a spaced collector section are incorporated as part of the vacuum enclosure and are electrically isolated from each other via a small ceramic seal provided in the region between said sections and also forming an integral part of the vaccum enclosure, said ceramic seal being covered by a metallic shield body whose one end is connected to said body section and the other end overlies and is spaced from said ceramic seal and said collector section, an insulator layer being interposed into the space between said metallic shield body and said ceramic seal and collector section for insulating the sections from one another, characterized in that said insulator layer extends beyond one end of said metallic shield body and a microwave-lossy is provided along at least one surface of said extended portion of the insulator layer to absorb microwave energy which may be transmitted along the insulator layer.

11. A microwave tube having a vacuum enclosure in which a body section and a spaced collector section form part of the vacuum enclosure and are electrically isolated from each other via a ceramic seal provided in a region between said sections and also forming an integral part of the vacuum enclosure, said insulating seal being covered by a metallic shield body whose one end is connected to said collector section and whose opposite end is spaced from and overlies said ceramic seal and said body section, an insulator layer being interposed in the space between said metallic shield body and said body section and said ceramic seal for insulating the sections from one another, characterized in that said insulator layer is extended beyond one of said metallic shield body and a microwave-lossy body is provided along at least one surface of said extended portion of the insulator layer to absorb microwave energy which may be transmitted along the inulator layer.

12. A microwave tube having a body section and a collector section spaced therefrom;

a ceramic seal positioned in the spaced region between said sections for electrically isolating said sections and forming an integral part of the vacuum enclosure for the tube;

first and second metallic shields each having first ends respectively connected to said body and collector sections;

said first and second shields having a plurality of spaced parallel portions extending respectively towards said collector and body portions and covering said ceramic seal, said spaced parallel portions being arranged in interleaved and telescoping fashion to thereby form an elongated, undulating tortuous path between said ceramic seal and the exterior of the outermost spaced parallel portion;

said path being filled with an isulating material having a large dielectric constant and covering said ceramic seal;

at least one layer of lossy material being interposed between one surface of said insulation material and the confronting surface of one of said spaced parallel portions to absorb microwave energy passing along said tortuous path.

13. The structure of claim 12, wherein each of said spaced parallel portions have cylindrically shaped cross-sections encircling said collector portion.

* * * * *